United States Patent [19]

Mariani

[11] Patent Number: 4,648,817

[45] Date of Patent: Mar. 10, 1987

[54] SUPERCHARGER FOR SUPPLYING A HEAT ENGINE OF A MOTOR VEHICLE

[75] Inventor: Lauro Mariani, Leghorn, Italy

[73] Assignee: Gilardini S.p.A., Turin, Italy

[21] Appl. No.: 722,504

[22] Filed: Apr. 12, 1985

[30] Foreign Application Priority Data

Apr. 16, 1984 [IT] Italy ..... 67383 A/84

[51] Int. Cl.[4] ..... F01C 1/24; F01C 21/06; B23P 15/10

[52] U.S. Cl. ..... 418/152; 418/83; 418/206; 74/606 A

[58] Field of Search ..... 418/206, 152, 153, 156, 418/178, 179, 83, 85; 29/156.4 R, 156.8 R, 23.5, 458, 460; 264/259, 262, 273; 74/606 A; 416/176

[56] References Cited

U.S. PATENT DOCUMENTS

| | | | |
|---|---|---|---|
| 1,046,773 | 12/1912 | Green | 418/206 |
| 2,014,932 | 9/1935 | Hallett | 418/179 |
| 2,105,428 | 1/1938 | Maglott | 418/206 |
| 2,492,935 | 12/1949 | McCulloch | 418/178 |
| 2,519,588 | 8/1950 | McCulloch | 418/152 |
| 2,978,532 | 4/1961 | Burnett | 264/262 |
| 3,170,409 | 2/1965 | McLeod | 418/152 |
| 3,174,408 | 3/1965 | Miller | 418/206 |
| 3,396,667 | 8/1968 | Schmitt | 418/152 |
| 3,918,838 | 11/1975 | Moody | 416/176 |
| 4,216,184 | 8/1980 | Thomas | 264/259 |
| 4,339,488 | 7/1982 | Brokmann | 264/273 |

FOREIGN PATENT DOCUMENTS

| | | | |
|---|---|---|---|
| 3331131 | 3/1985 | Fed. Rep. of Germany | 74/606 A |
| 192991 | 11/1983 | Japan | 418/152 |
| 5364 | 3/1893 | United Kingdom | 418/179 |

*Primary Examiner*—Carlton R. Croyle
*Assistant Examiner*—Jane Obee
*Attorney, Agent, or Firm*—Gifford, Groh, VanOphem, Sheridan, Sprinkle and Dolgorukov

[57] ABSTRACT

A supercharger for supplying a heat engine of a motor vehicle includes a main body having a working chamber in which rotate at least two bodies continuously sealed along at least one generatrix parallel to the axis of the main body and in which said chamber is in communication with an intake duct and an outlet duct. The main characteristic of this supercharger lies in the fact that it comprises constituent parts made with a relatively rigid supporting structure having an external form provided by moulding material onto the supporting structure.

13 Claims, 9 Drawing Figures

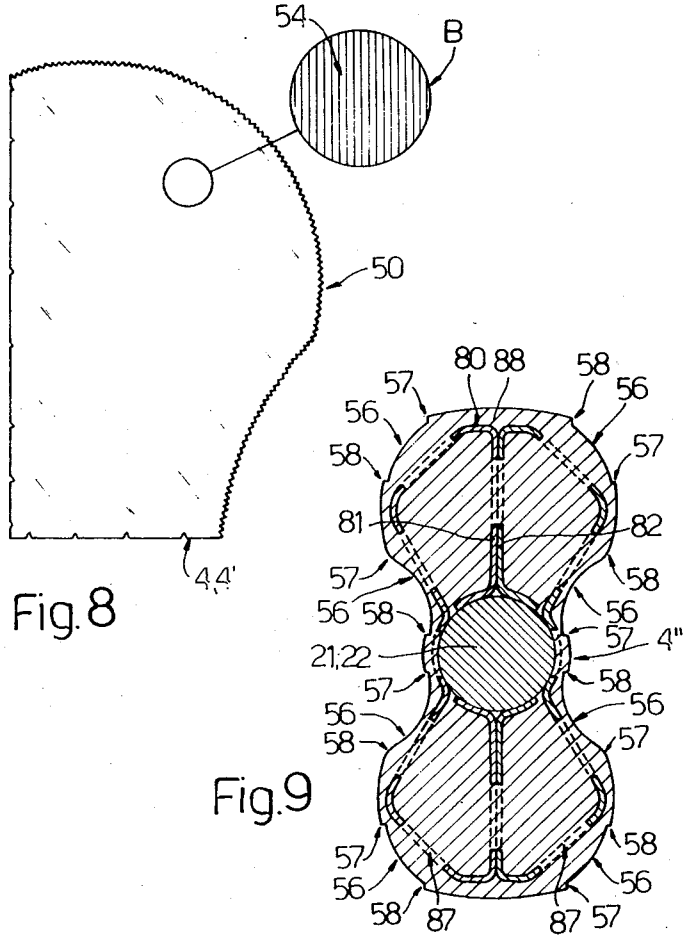
B
54
50
4,4'
Fig.8
4"
56
57
58
82
88
80
81
21,22
87
Fig.9
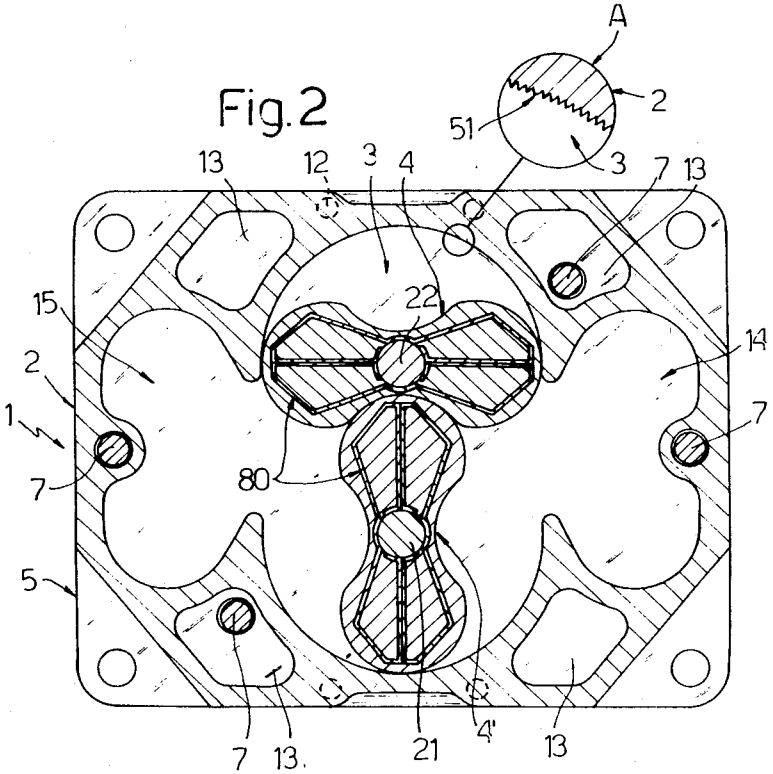
A
2
3
51
7
13
14
4
22
12
80
21
4'
15
1
5
Fig.2

SUPERCHARGER FOR SUPPLYING A HEAT ENGINE OF A MOTOR VEHICLE

BACKGROUND OF THE INVENTION

The present invention relates to a supercharger for supplying heat engines of vehicles, in particular for supplying the cylinders of spark-ignition internal combustion engines or diesel engines of motor vehicles.

Superchargers, particularly positive-displacement superchargers known in the prior art for this application, comprise a main body having a working chamber in which two lobed bodies rotate, which bodies always form a seal along a generatrix parallel to the axis of the main body. Moreover, this working chamber is in communication with an intake duct and an outlet duct, which ducts are disposed radially in the main body, and the two rotating bodies are often made of cast iron.

This known configuration involves various disadvantages, however, such as a relatively high weight of the supercharger, the necessity of having to perform different working stages during production, and a relatively large transverse size of the main body.

SUMMARY OF THE INVENTION

The object of the present invention is to provide a supercharger, particularly but not exclusively a supercharger of the positive displacement type, for supplying heat engines of vehicles, which overcomes the above indicated disadvantages, which will be of more economic construction and with a very much reduced weight, combined with a simpler production process, and which will be easily adaptable to different technical applications.

Other objects and advantages obtained with the supercharger of the present invention will become apparent from the following description.

According to the present invention a supercharger for supplying a heat engine of a motor vehicle comprises a main body having a working chamber within which rotate at least two bodies which always form a seal along at least a generatrix parallel to the axis of the said main body, and in which said chamber is in communication with intake and outlet ducts, characterised by the fact that it includes constituent parts made with a relatively rigid support structure and having an external form obtained by moulding material onto the said support structure.

BRIEF DESCRIPTION OF THE DRAWINGS

For a better understanding of the present invention various particular embodiments will now be described, purely by way of non limitative example, with reference to the attached drawings, in which:

FIG. 2 is a sectioned view taken on the line II—II of the supercharger of FIG. 1;

FIG. 8 is a partial end view of an internal rotating body of the supercharger of FIG. 1; and FIG. 9 is a transverse sectioned view of a different embodiment of a rotating body within the working chamber of the supercharger of FIG. 1.

DETAILED DESCRIPTION OF THE INVENTION

Figure 1:
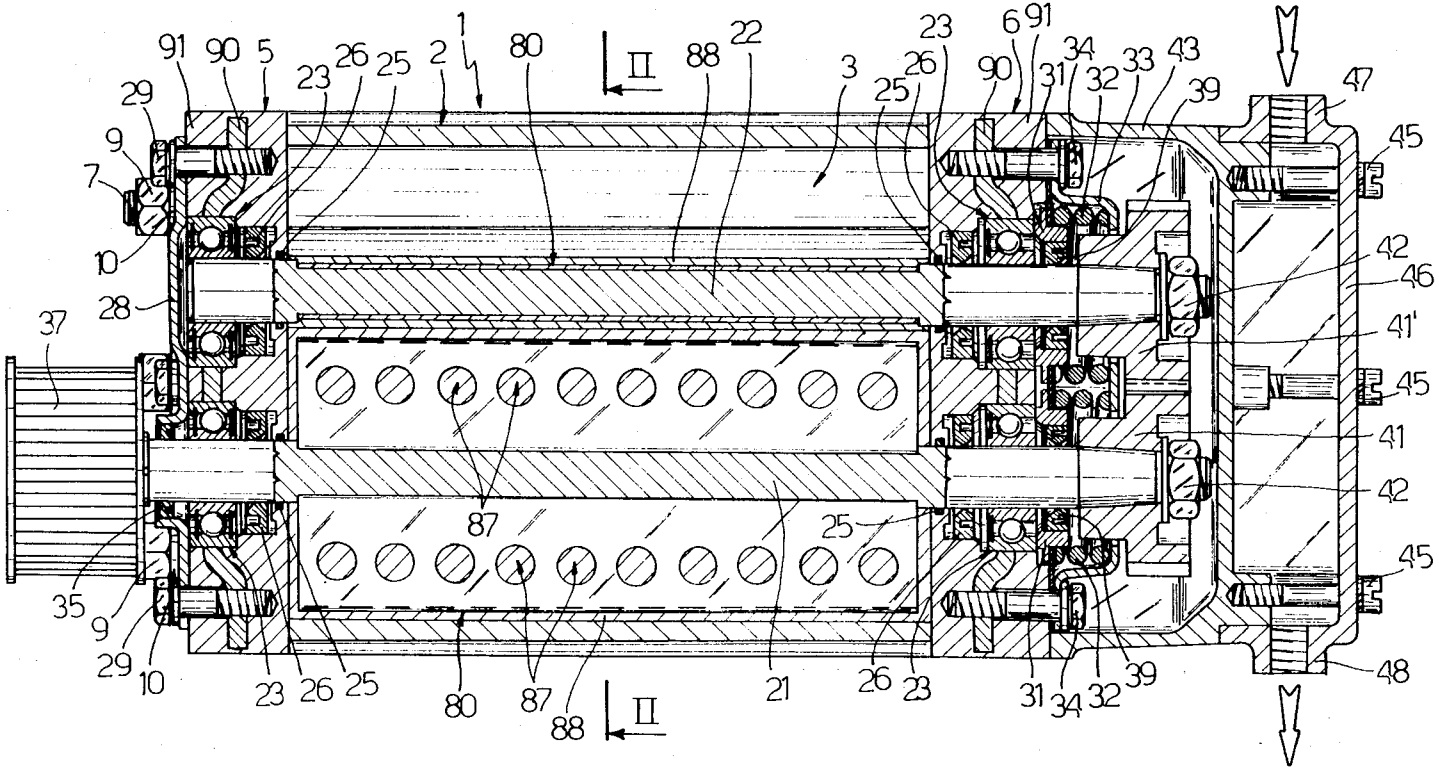
FIG. 1 is a sectioned side view of a first embodiment of a positive displacement supercharger according to the present invention.

Referring to FIGS. 1 and 2, a positive displacement supercharger according to the present invention is generally indicated with the reference numeral 1, which supercharger comprises a main body 2 defining within it a working chamber 3 in which rotate two bodies 4, 4' which are always sealed along at least one generatrix parallel to the longitudinal axis of the main body 2. This working chamber 3 is closed at its ends by two end caps 5 and 6 which are sealingly fixed onto the main body 2 by four rods 7 which pass through the main body 2 parallel to its axis. The rods 7 have threaded ends one of which is connected to the end cap 6 in a manner which will be illustrated in greater detail below, and the other of which projects externally from the opposite end cap 5 and onto which is screwed a corresponding locking nut 9 with a washer 10. The precise angular positioning between the main body 2 and the end caps 5 and 6 is further determined by a plurality of centering pins 12 (FIG. 2). The main body 2 is elongated and defines an axis of the working chamber 3, and is conveniently made by extrusion, of aluminium alloy, with lightening holes 13 extending longitudinally therethrough. In communication with the working chamber 3 there are formed, in the main body 2, an intake duct 14 and an outlet duct 15 in counterposed positions, which lie parallel to the axis of the main body 2 and which extend for the whole of its length. These ducts 14 and 15 are in communication, with respective through ducts 16 (FIG. 4) formed in the end cap 6 itself, and also extending substantially parallel to the longitudinal axis of the supercharger 1.

Figure 3:
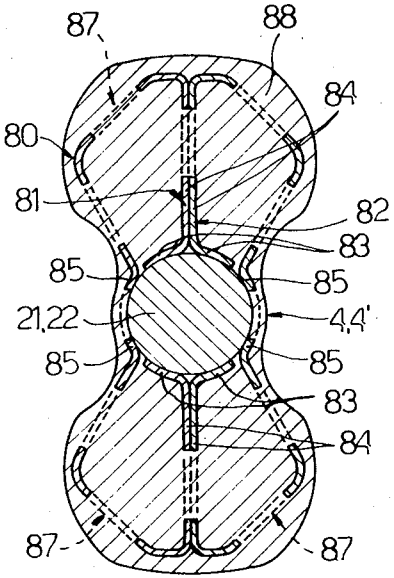
FIG. 3 is a transverse sectioned view of a rotating body of the supercharger of FIG. 2.

In accordance with the present invention these rotating bodies 4 and 4' and the end caps 5 and 6 each comprise a relatively rigid, conveniently metal, supporting structure, and an exterior formed from a plastic material molded thereon, conveniently by injection molding. The two rotating bodies 4 and 4', illustrated in greater detail in FIG. 3, have a supporting structure 80 which is made from sheets of steel the lengths of which are almost equal to the length of these bodies 4 and 4' and which are shaped with a form similar to the external shape of these bodies. In particular, this supporting structure 80 comprises two sheets 81 and 82, the ends 83 of which are fixed, for example welded, onto respective spindles 21 and 22. The spindles 21 and 22 are conveniently made of steel and are disposed parallel to the axis of the main body 2 and supported at their ends by ball bearings 23 housed in the end caps 5 and 6 in a manner which will be described subsequently. The two sheets 81 and 82 (FIG. 3) have facing and diametrically opposite sections 84 which first diverge outwardly and then are again fixed to the spindles 21 and 22 by intermediate portions 85. These sheets 81 and 82 have a plurality of holes 87 which, as well as allowing the passage of the welding electrodes for fixing the ends 83 and the portion 85 onto the spindles 21 and 22 also allow the passage of material 88 which is molded onto the supporting structure 80 to form the exterior desired for the rotating body 4 or 4' which, as illustrated in FIGS. 2 and 3, the rotating bodies 4 and 4' have complementary perimetral profiles with a mutual seal along a substantially continuous line with each other. The two rotating bodies 4 and 4' therefore have a substantially lobed external form and have a length substantially equal to that of the working chamber 3.

The end caps 5 and 6 also have a supporting structure 90 conveniently made of sheet steel suitably shaped and pierced so as to provide the various holes for housing and connection of the various component parts and for ducts 16 passing therethrough. On the supporting structure 90 there is molded, conveniently by injection molding a material 91, suitably a plastics material, to form the desired exterior shape. These end caps 5 and 6 therefore completely close the ends of the working chamber 3 with the exception of the ducts 16 passing through the end cap 6 and holes for the passage of the end spindles 21 and 22, on which, in the internal portions of the end caps 5 and 6, are positioned circular sealing rings 25 and lip seals 26 which are interposed between these sealing rings 25 and the ball bearings 23.

The two ball bearings 23 housed in the end cap 5 are positioned axially by an external metal plate 28 fixed with screws 29 onto the external surface of the end cap 5, whilst the two ball bearings 23 housed in the end cap 6 are positioned with automatic adjustment of the axial play by means of the bushes 31 acting on the external front surface of the bearings 23, which can slide axially in the seat formed in the end cap 6. These bushes 31 have an external peripheral edge against which engages one end of a respective spring 32 on which, at the other end, acts a cup 33 which is fixed by screws 34 onto the outer surface of the end cap 6.

At its left hand end is shown in FIG. 1, the spindle 21 projects out from the plate 28 through a hole in which there is interposed a sealing ring 35, and a driving pulley 37 is fixed on the projecting end for rotation with the spindle. At the other end the spindle 21 and the adjacent end of the spindle 22 pass through respective bushes 31 with the interposition of an annular lip seal 39, and have a frustoconical end section on which is fixed a respective gear wheel 41 and 41' which mesh together externally of the cup 33. These gear wheels 41 and 41' are secured axially by means of nuts 42 screwed onto the threaded ends of the spindles 21 and 22. The space containing these gear wheels 41 and 41' is enclosed by a casing 43 which is fixed on the end cap 6 in a manner which will be described subsequently in more detail. The space enclosed by this casing 43 is conveniently filled with lubricating material for the gear wheels 41 and 41', such as lubricating grease. Over the casing 43 there is connected a casing 46, by means of screws 45, which has inlet and outlet ducts 47 and 48 respectively, for a passage therethrough of a coolant fluid.

For the purpose of improving the fluid tight seal in the working chamber 3, for the fluid which is transferred between the intake duct 14 and the outlet duct 15, there is provided a labyrinth seal both between the facing surfaces of the two rotating bodies 4 and 4' and between the facing surfaces of these rotating bodies 4 and 4' and the inner surfaces of the working chamber 3, as well as between the surfaces of the ends of these rotating bodies 4 and 4' and the end caps 5 and 6. These sealing means comprise a plurality of adjacent surface ribs 50 (FIG. 8) formed on the surfaces of the rotating bodies 4 and 4' along generatrices parallel to the axis; by means of a plurality of facing surface ribs 51 formed on the inner surface of the working chamber 3 of the main body 2 in a direction parallel to its longitudinal axis as is visible in the detail A of FIG. 2; and by means of parallel surface ribs 54 formed on the end surfaces of the rotating bodies 4 and 4' as can be seen in the detail B of FIG. 8. Conveniently the material 88 with which the rotating bodies 4 and 4' are made can be abrasive material so as to be dimensionally self adapting by abrasion on the surfaces of the end caps 5 and 6, on the internal surface of the working chamber 3 and between the rotating bodies 4 and 4'. This material 88 is advantageously resistant to petrol and to high temperatures. The rotating bodies 4 and 4' can have a skin or covering of several tenths of a millimeter, and the peaks of the ribs 50, 51 and 54 can be of the order of 0.1 to B 0.4 mm.

As can be seen in FIG. 9, in an alternative embodiment the rotating bodies 4 and 4' can have complementary perimetral profiles with mutual sealing contact along a discontinuous line instead of along a continuous line, this being formed by spaces 56 of very small height and without the necessity of high precision of surface working since there is no mutual contact between the two bodies 4 and 4' in that the contact is displaced directly between the generatrices 57 and 58 on either side of each space 56 concerned.

Figure 4:
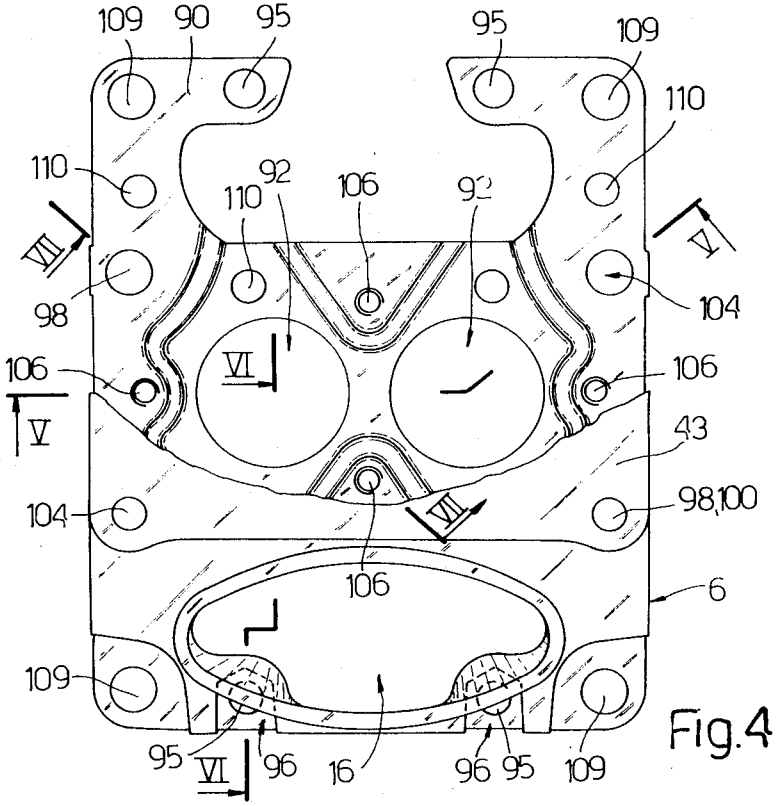
FIG. 4 is a partial front view of an end cap of the supercharger of FIG. 1.
Figure 7:
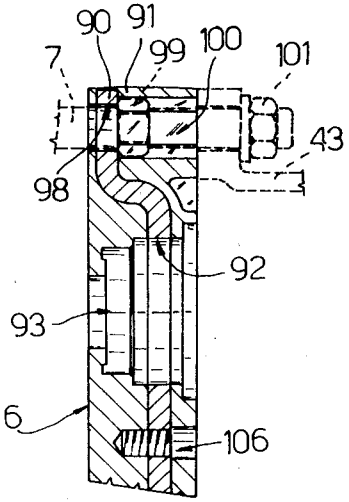
FIGS. 5,6 and 7 are sectioned views taken on the lines V—V, VI—VI and VII—VII respectively, of the complete end cap of FIG. 4.
Figure 6:
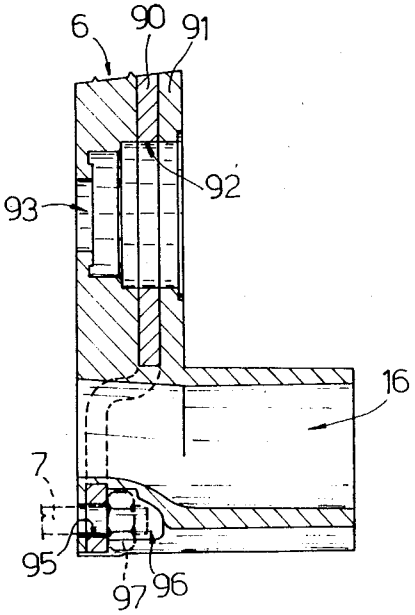
Figure 5:
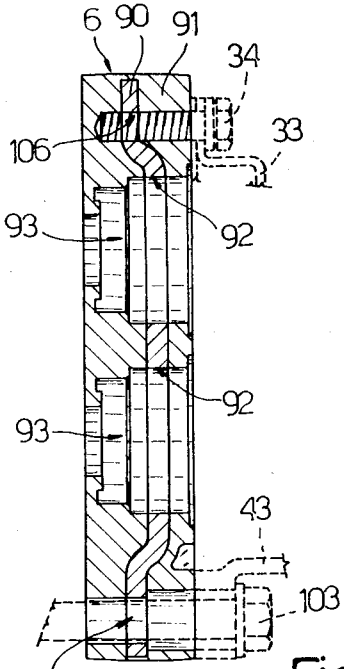

With reference to FIG. 4, in the supporting structure 90 for the end cap 6, and similarly for the end cap 5, there are formed two holes 92 in which are housed ball bearings 23 for supporting the two spindles 21 and 22, and in the material 91 there are formed, coaxially with these holes 92, housings 93 (FIGS. 5,6 and 7) for the sealing rings 25, the lip seals 26 and the bushes 31. In this supporting structure 90 there are also formed two pairs of holes 95 in which are inserted the threaded ens of the rods 7 for the axial assembly of the supercharger 1, and on these threaded ends, in a space 96 formed in the material 91, there are fixed nuts 97 (FIG. 6). In this supporting structure 90, towards the central zone, two holes 98 are formed in diagonally opposite positions, through which holes pass the threaded ends of another two rods 7 on each of which is fixed a nut 99 (FIG. 7) housed in a respective cavity 100 of corresponding section formed in the material 91 of the end cap 6; the ends of these rods 7 then project from the end cap 6 and each receives a nut 101 which fixes the casing 43 onto the end cap 6. This casing 43 is moreover fixed at the other two corners by means of two screws 103 which pass through holes 104 formed in the structure 90 (FIGS. 4 and 5). In this supporting structure 90 there are then formed four holes 106 in which the screws 34 are screwed which fix the cup 33 against the end cap 6. This supporting structure 90 has four holes 109 at the four corners, in which can be disposed elements (not illustrated) for fixing to a convenient support; moreover, it also has two apertures for providing through ducts 16, and there are formed other holes 110 which facilitate the diffusion of the material 91. The supercharger 1 formed according to the present invention therefore has various advantages, such as a great simplicity in surface working and therefore economy in production, together with a relatively light weight. The provision of rotating bodies 4 and 4' as a supporting structure 80 covered with molded material 88 in the desired form allows these rotating bodies to be made relatively lighter with a low moment of inertia, thus permitting higher speed of rotation with a superior performance. It is also advantageous to form the end caps 5 and 6 with the supporting structure 90 which guarantees the required rigidity and onto which is molded the material 91 in the desired external form and with the desired various internal spaces, thus obtaining characteristics of production economy and lightness with sufficient robustness. Moreover this production technique allows the thermal expansion to be made dependant principally on that of the supporting structure 80 and 90 which, if made of the same material, conveniently steel, permits similar reduced thermal expansions to be obtained.

The fluid seal in the working chamber 3 is thus guaranteed in an extremely satisfactory manner by means of the ribs 50 formed on the surfaces of the rotating bodies 4 and 4', by means of the ribs 51 formed on the inner surfaces of the working chamber 3, and by means of the ribs 54 formed on the end surface of the rotating bodies 4 and 4'. These ribs can be only partially formed on some component parts, depending upon the required characteristics of the supercharger. With these ribs, as well as providing the above described seal, there is obtained the benefit of being able to allow the greatest amount of play between the rotating bodies 4 and 4', and between the rotating bodies 4 and 4' and the fixed bodies 2,5,6; thus with lower working tolerances a greater production economy is obtained. The arrangement for compensating axial play of the ball bearings 23 by means of the bushes 31 on which the springs 32 resting on the cup 33 act is also advantageous for obtaining a fluid-tight seal in the working chamber 3. Further, the formation of the rotating bodies 4'' with the profile illustrated in FIG. 9, that is to say with mutual sealing contact along a discontinuous line, allows a production economy in that the working precision required for the spaces 56 is reduced.

The casing 46 disposed in thermal contact with the casing 43, but hermetically sealed therefrom, allows the heat generated between the gear wheels 41 and 41' to be dissipated by the circulation of a coolant fluid, for example the coolant fluid of the engine flowing between the inlet and outlet ducts 47 and 48.

It is also advantageous to produce the main body 2 by extrusion, with the characteristic that the intake duct 14 and outlet 15 are disposed in directions parallel to the longitudinal axis of the main body 2. This main body 2 can therefore be made in aluminium or in other light alloy, and can have a relatively small transverse size in that the inlet and outlet openings for the fluid can be made on the end faces of one of the end caps 5 or 6. Such a structure does not necessitate expensive working operations in that it is necessary only to work the inner surface of the working chamber 3 and the end faces in contact with the end caps 5 and 6 and it is easy to provide different performance characteristics simply by varying the length of the main body 2.

Finally, it is clear that the described embodiments of the supercharger of the present invention can be varied and modified without departing from the scope of the invention. Among other things, only the rotating bodies 4 and 4' or only the end caps 5 and 6 may be made with the described characteristics of a relatively rigid supporting structure and an external form provided by molding onto this supporting structure; in this latter case the rotating bodies 4 and 4' can be made with an extrusion process, conveniently provided with cavities extending therethrough and closed by end plugs. The casing 46 for cooling fluid can also be omitted and the main body 2 could have a different configuration from that described, for example it could have intake and outlet ducts and through passages 16 opening to the outside radially of the working chamber 3. Moreover the supporting structure 90 for the end caps 5 and 6 can have a different configuration and, among other things, in place of or together with fixing holes 109 it can have tabs at the four corners folded for example at 90° C., with convenient holes for fixing to a support.

I claim:

1. A supply supercharger for an engine of a motor vehicle, comprising:

an elongated main body having an axis and a portion defining a working chamber therein;

at least two rotating bodies disposed in said working chamber which are continuously sealed along at least a generatrix parallel to said axis;

at least one intake duct and at least one outlet duct in communication with said chamber; and two opposing end caps axially delimiting said chamber;

wherein at least one of said end caps and said rotating bodies comprises a skeleton and a molded material disposed about said skeleton.

2. The invention according to claim 1, wherein each of said end caps and said rotating bodies comprise an individual skeleton and a molded material disposed about said individual skeleton.

3. The invention according to claim 1, wherein said rotating bodies each comprise a shaft parallel to said axis, a skeleton affixed to said shaft, and a molded material disposed about said skeleton.

4. The invention according to claim 1, additionally comprising at least one other component element; wherein said end caps each comprise a skeleton and a molded material disposed about said skeleton; and wherein said skeletons define at least one of an aperture and a seat, for at least one of housing said component element and fixing said component element to said supercharger.

5. The invention according to claim 1, wherein said skeleton comprises metal, and said material comprises an injection molded plastic.

6. The invention according to claim 1, wherein said rotating bodies include end portions adjacent said end caps; and further comprising fluid seal means between and sealing at least one of: said pair of rotating bodies; said rotating bodies and said main body; and said end portions of said rotating bodies and said end caps.

7. The invention according to claim 6, wherein said fluid seal means is a labyrinth seal comprising a plurality of ribs on at least one of: said pair of rotating bodies; said rotating bodies and said main body; and said end portions of said rotating bodies and said end caps.

8. The invention according to claim 1, wherein said rotating bodies comprise complementary perimetral profiles having mutually sealing contact along a substantially continuous line.

9. The invention according to claim 1, wherein said rotating bodies comprise complementary perimetral profiles having mutually sealing contact along a discontinuous line.

10. The invention according to claim 1, wherein said intake and said outlet ducts are formed in said main body parallel to said axis of said main body.

11. The invention according to claim 1, wherein said skeleton comprises a second material denser than said molded material disposed about said skeleton.

12. The invention according to claim 1, wherein one of said rotating bodies is externally driven, and further comprising: a gear chamber external to said main body; a gear coupling affixed to said rotating bodies for imparting rotation to the other of said rotating bodies, said gear chamber being filled with lubricating grease; and a passage for cooling fluid disposed in thermal contact with but hermetically sealed from said gear chamber.

13. The invention according to claim 12, comprising a casing defining said cooling fluid passage and including cooling fluid inlet and outlet ducts.

* * * * *